US010215029B2

(12) United States Patent
Wygant

(10) Patent No.: US 10,215,029 B2
(45) Date of Patent: Feb. 26, 2019

(54) BLADE ASSEMBLY

(71) Applicant: Hanwha Techwin Co., Ltd., Changwon-si (KR)

(72) Inventor: Karl Wygant, Houston, TX (US)

(73) Assignee: HANWHA POWER SYSTEMS CO., LTD., Changwon-si (KR)

( * ) Notice: Subject to any disclaimer, the term of this patent is extended or adjusted under 35 U.S.C. 154(b) by 328 days.

(21) Appl. No.: 15/007,534

(22) Filed: Jan. 27, 2016

(65) Prior Publication Data

US 2017/0211391 A1 Jul. 27, 2017

(51) Int. Cl.
*F01D 5/16* (2006.01)

(52) U.S. Cl.
CPC ..... *F01D 5/16* (2013.01); *F05D 2220/31* (2013.01); *F05D 2220/32* (2013.01); *F05D 2230/22* (2013.01); *F05D 2240/303* (2013.01); *F05D 2260/96* (2013.01)

(58) Field of Classification Search
CPC ... F01D 5/10; F01D 5/16; F01D 5/181; F01D 5/26; F01D 25/04; F01D 25/06; F05D 2260/96
See application file for complete search history.

(56) References Cited

U.S. PATENT DOCUMENTS 2,349,187 A * 5/1944 Meyer ..... F01D 5/16 188/322.5
2,984,453 A * 5/1961 Heymann ..... F01D 5/16 416/229 A
5,219,144 A * 6/1993 Fox ..... F16F 7/10 248/562
5,232,344 A * 8/1993 El-Aini ..... F01D 5/16 416/145
5,820,348 A * 10/1998 Fricke ..... F01D 5/027 188/268
5,924,845 A * 7/1999 Bagley ..... F01D 5/26 188/378
7,147,437 B2 12/2006 Burdgick et al.
7,347,664 B2 3/2008 Kayser et al.
7,594,325 B2 9/2009 Read
8,186,057 B2 * 5/2012 Harrison ..... F01D 5/027 29/889
8,701,286 B2 4/2014 Strother

FOREIGN PATENT DOCUMENTS

KR 10-2006-0050297 A 5/2006

* cited by examiner

*Primary Examiner* — Dwayne J White
*Assistant Examiner* — Adam W Brown
(74) *Attorney, Agent, or Firm* — Sughrue Mion, PLLC

(57) ABSTRACT

A blade assembly including a rotor; a body portion connected to the rotor and having a space therein; and at least one vibration reduction member provided in the space.

9 Claims, 6 Drawing Sheets

BLADE ASSEMBLY

BACKGROUND

1. Field

Apparatuses consistent with exemplary embodiments relate to blade devices, and more particularly, to blade assemblies.

2. Description of the Related Art

In the related art, a blade assembly may be used in various devices. For example, a blade assembly may be used in a compressor, a gas turbine, a steam turbine, and so on to generate an internal fluid flow by a rotation thereof. The blade assembly may be deformed during rotation thereof.

The blade assembly may include a rotor and a body portion connected to the rotor and rotating together with the rotor. The body portion may have a airfoil shape and may generate a fluid flow by rotating together with the rotor.

The body portion may rotate with a constant frequency and may be placed into a vacuum state when the rotation frequency becomes equal to a multiple of the resonance frequency.

When the body portion is in a vacuum state, parts thereof may deform/extend in a longitudinal direction. When the deformation occurs, an increased dynamic stress may act on the body portion which may result in breakage of the blade assembly or shortening of the lifespan thereof.

For example, the body portion can be subject to high levels of static arising from centrifugal and/or thermal forces resulting in low tolerance to dynamic stress levels. Many the gas/steam turbines and other compressor applications are subjected to frequent acceleration and deceleration. During these periods of acceleration or deceleration, the blade assembly may be momentarily subjected to high dynamic stresses while transitioning through resonance related conditions. When the blade assembly is subject to dynamic forces at or near the resonant frequency of the blade assembly, the amplitude of stress can readily build up to a point where fatigue related fractures occur. Under controlled test conditions, fatigue related fractures can occur after only a few seconds of operation due to dynamic stress associated with a blade resonance.

To attenuate the level of dynamic stresses in the blade assembly, various damping mechanisms have been introduced. For example, damping in the airfoil and/or airfoil to disk connection acts to reduce the level of dynamic stress at or near resonance conditions. The methods of the related art to introduce damping into the blade assembly can lead to wear and stress concentrations (lacing wires) fretting (contact zone mechanisms) and/or introduce damping at non-ideal locations.

SUMMARY

One or more exemplary embodiments provide a mechanism which inherently dampens vibratory motion without requiring an external apparatus that may disturb the flow field adversely.

One or more exemplary embodiments also provide a blade assembly which inherently resists fracture from dynamic stresses by introducing damping at internal locations to reduce dynamic stress levels.

One or more exemplary embodiments also provide a blade assembly that is inherently self-damping.

One or more exemplary embodiments also provide a blade assembly where internal friction forces are utilized to achieve effective damping.

Additional aspects will be set forth in part in the description which follows and, in part, will be apparent from the description, or may be learned by practice of the exemplary embodiments.

According an aspect of an exemplary embodiment, there is provided a blade assembly including a rotor; a body portion placed in the rotor and having a space therein; and at least one vibration reduction member inserted in the space.

In an exemplary embodiment, the space may be formed adjacent to a leading edge of the body portion.

In an exemplary embodiment, the space may be formed in a part of the body portion at a position where a maximum variable displacement of the body portion occurs during rotation thereof.

In an exemplary embodiment, the at least one vibration reduction member may be of a powder type.

In an exemplary embodiment, the space may include a plurality of spaces; and some of the plurality of the spaces are separated from each other in a direction dividing a fluid flow of a fluid flowing along a surface of the body portion.

According an aspect of another exemplary embodiment, there is provided a blade assembly including: a rotor; a body portion connected to the rotor and comprising a space therein; and at least one vibration reduction member provided in the space.

The space may be provided adjacent to a leading edge of the body portion.

The space may be provided at a position where a maximum variable displacement of the body portion occurs during rotation thereof.

The at least one vibration reduction member may be of a powder type.

The space may include a plurality of spaces; and the plurality of the spaces may be arranged in a direction extending from a leading edge of the body portion to a trailing edge of the body portion.

The plurality of the spaces may be arranged in a radial direction of the body portion.

The at least one vibration reduction member may be configured to generate a frictional contact with the space.

A frictional force generated by the frictional contact may have a different phase from a speed of the at least one vibration reduction member.

The at least one vibration reduction member may be configured to rotate in a speed slower than a rotation speed of the body portion.

The at least one vibration reduction member may be configured to rotate in the speed slower than the rotation speed of the body portion at a resonance frequency.

According to the exemplary embodiments, the lifespan of the rotating blade assembly may be increased.

BRIEF DESCRIPTION OF THE DRAWINGS

The above and/or other aspects of the disclosure will become apparent and more readily appreciated from the following description of the embodiments, taken in conjunction with the accompanying drawings in which.

DETAILED DESCRIPTION

Figure 1:
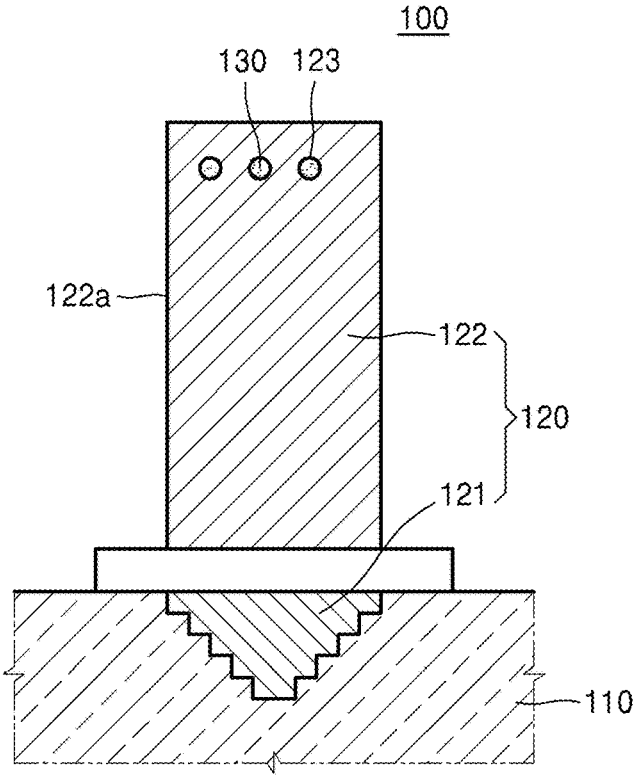
FIG. 1 is a conceptual diagram of a blade assembly according to an exemplary embodiment.

Reference will now be made in detail to exemplary embodiments, examples of which are illustrated in the accompanying drawings, wherein like reference numerals refer to like elements throughout. In this regard, the exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

It will be understood that, although the terms first, a second, etc. may be used herein to describe various elements, components, regions, layers and/or sections, these elements, components, regions, layers and/or sections should not be limited by these terms. Thus, a first element, component, region, layer or section discussed below could be termed a second element, component, region, layer or section without departing from the teachings of the inventive concept.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of at least one other features, integers, steps, operations, elements, components, and/or groups thereof.

Figure 2:
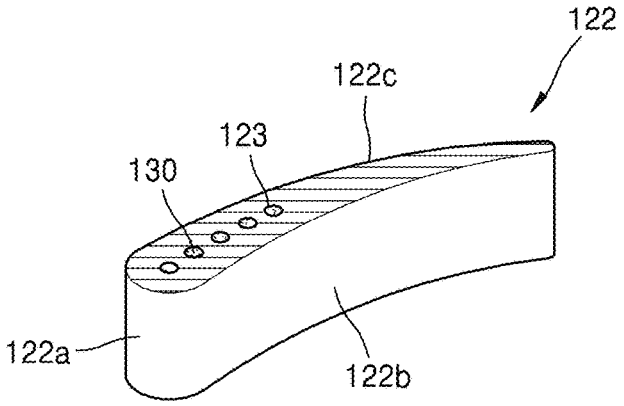
FIG. 2 is a perspective view of the blade assembly in FIG. 1 after cutting a part thereof.
Figure 3A:
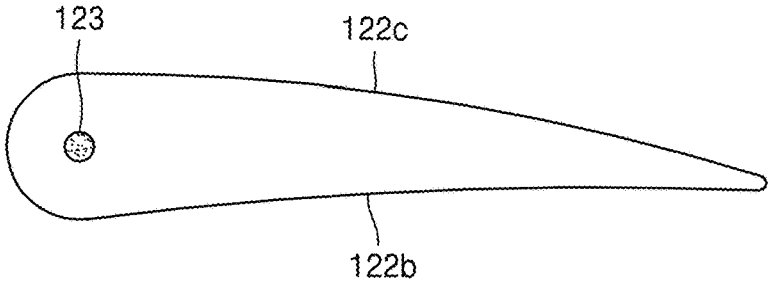
FIGS. 3A-3C are horizontal cross-sectional views of a blade assembly according to exemplary embodiments.
Figure 3B:
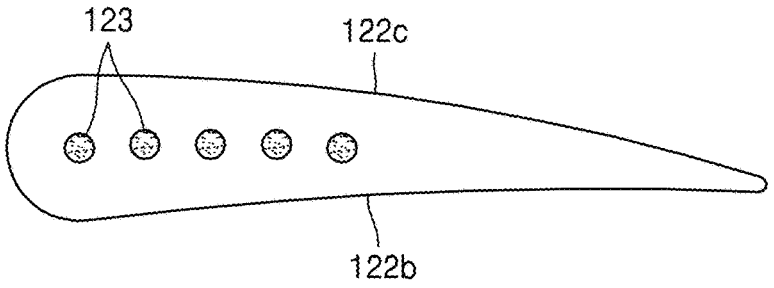
Figure 3C:
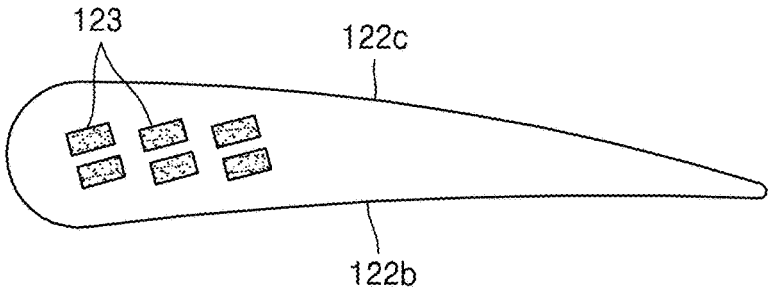
Figure 4A:
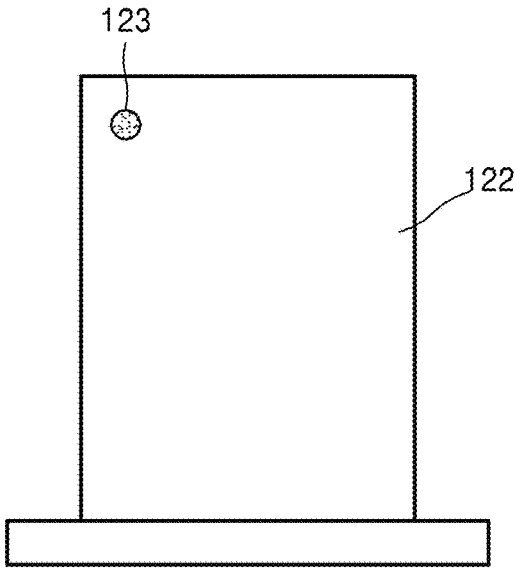
FIGS. 4A-4C are vertical cross-sectional views of a blade assembly according to exemplary embodiments.
Figure 4B:
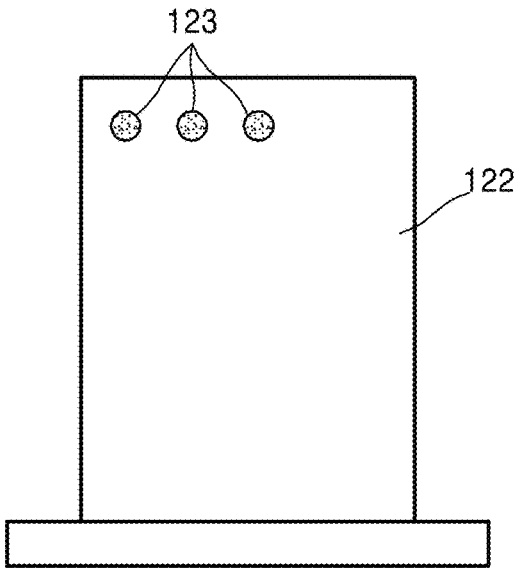
Figure 4C:
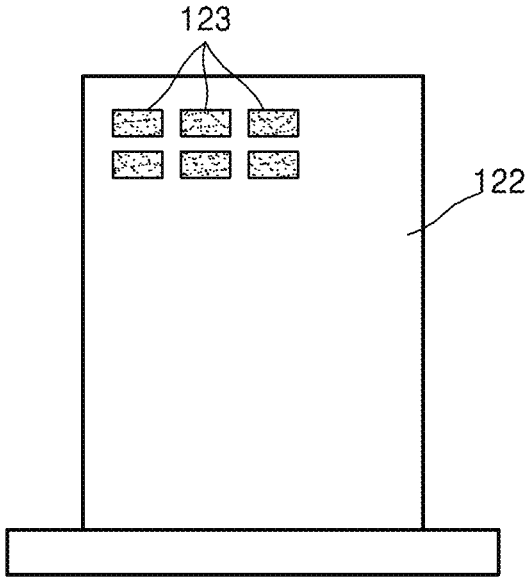
Figure 5:
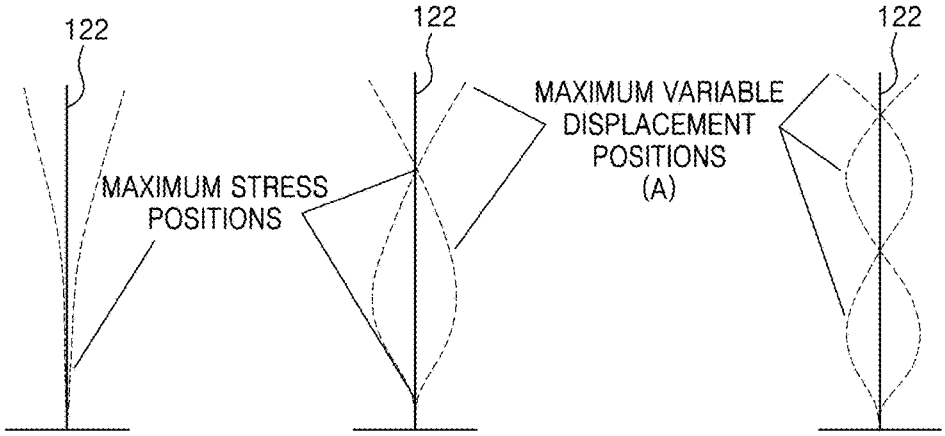
FIG. 5 is a conceptual diagram of a displacement of a blade of the related art during rotation thereof.
Figure 6:
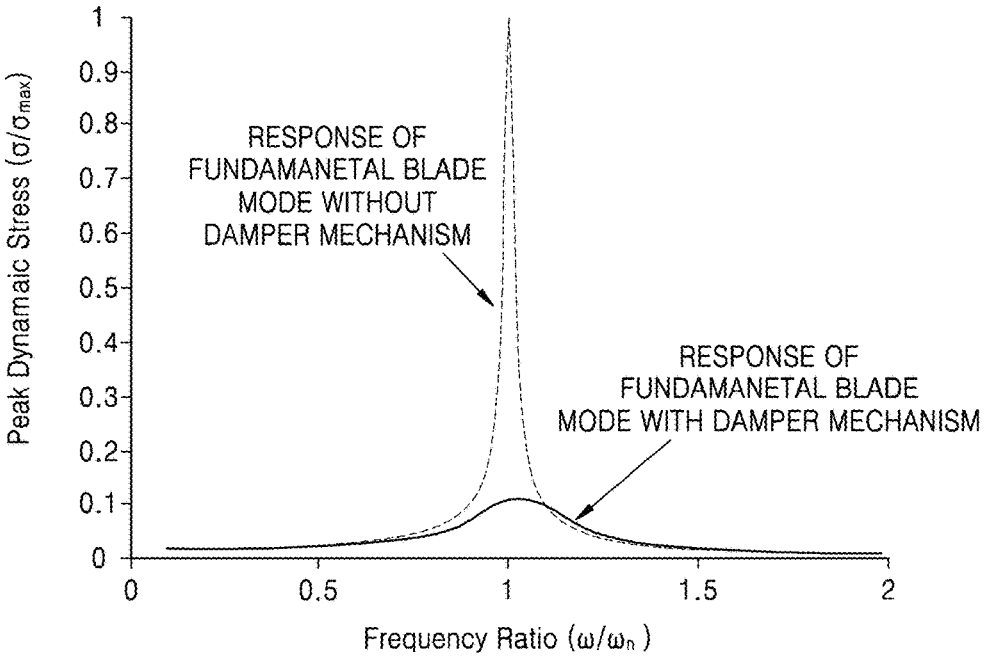
FIG. 6 is a graph of a dynamic stress ratio according to a frequency ratio of the blade assembly in FIG. 1.
Figure 7:
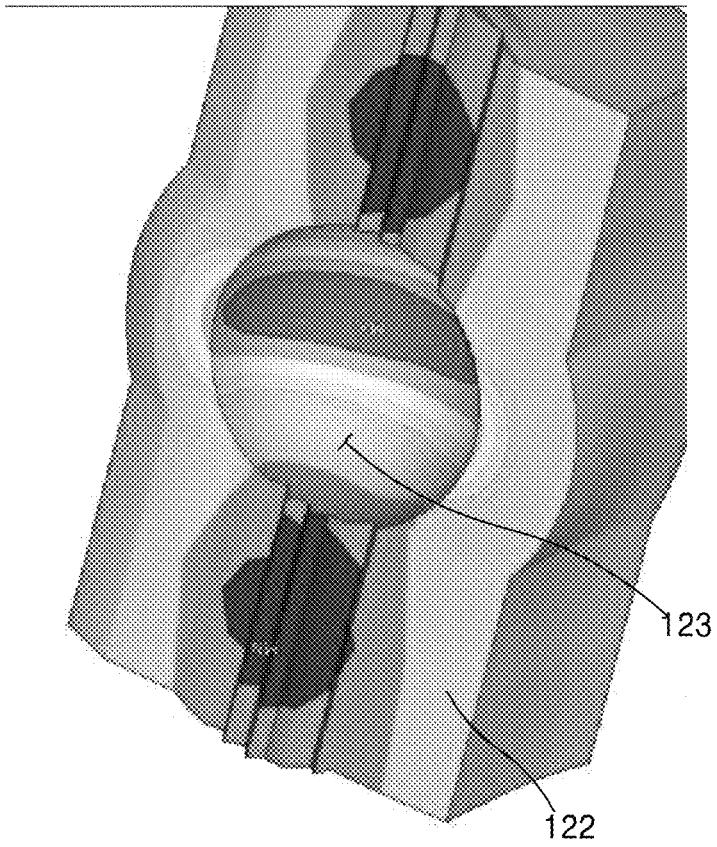
FIG. 7 is a view of stress distribution of the blade assembly in FIG. 1.

FIG. 1 is a conceptual diagram of a blade assembly 100 according to an exemplary embodiment. FIG. 2 is a perspective view of the blade assembly 100 in FIG. 1 after cutting a part thereof. FIGS. 3A-3C are horizontal cross-sectional views of a blade assembly according to exemplary embodiments. FIGS. 4A-4C are vertical cross-sectional views of a blade assembly according to exemplary embodiments. FIG. 5 is a conceptual diagram of a displacement of a blade of the related art during rotation thereof. FIG. 6 is a graph of a dynamic stress ratio according to a frequency ratio of the blade assembly in FIG. 1. FIG. 7 is a view of stress distribution of the blade assembly in FIG. 1.

Referring to FIGS. 1 to 5, the blade assembly 100 may include a rotor 110, a body portion 120, and a vibration reduction member 130.

The rotor 110 may be placed in an external device and rotate therein. The rotor 110 may be connected to various devices or structures according to the external device in which the blade assembly 100 is placed. For example, when the external device is a compressor according to an exemplary embodiment, the rotor 110 may be connected to a driving unit such as a motor. When the external device is a gas turbine according to an exemplary embodiment, the rotor 110 may be placed in a case and be rotated by energy that is generated by fuel combustion. When the external device is a steam turbine according to an exemplary embodiment, the rotor 110 may rotate by steam energy supplied from the outside. Hereinafter, the case when the external device is a compressor will be described in detail for convenience of explanation.

The body portion 120 may be connected and fixed to an outer surface of the rotor 110. In the exemplary embodiment, the body portion 120 may include a hub 121 connected to the rotor 110, and a blade body portion 122 formed to be connected to the hub 121.

A part of the hub 121 is inserted in the rotor 110 or a part of the rotor 110 is inserted in the hub 121, and thus, the hub 121 and the rotor 110 may be connected to each other.

The blade body portion 122 may be of a blade type. In the exemplary embodiment, the blade body portion 122 may include a leading edge 122*a* which contacts a fluid first according to a fluid flow direction. Thus, the leading edge 122*a* may be formed in a streamlined shape or a curved surface shape and guide a fluid along both sides thereof.

The blade body portion 122 may include a pressure surface 122*b* and a suction surface 122*c* formed on both sides of the leading edge 122*a* as shown in FIG. 2. The pressure surface 122*b* and the suction surface 122*c* may face each other and may be connected to each other at a terminal end (i.e., a trailing edge) by extending from each of the both sides of the leading edge 122*a*.

At least one space 123 may be formed in the blade body portion 122. The space 123 may have a circular shape, a columnar shape, an elliptical columnar shape, or a polygon column shape. That is, as shown in FIGS. 3A-4C, the blade body portion 122 may include only one space 123 (FIGS. 3A and 4A) and more than one spaces (FIGS. 3B and 4B). The blade body portion 122 may include a columnar shape (FIGS. 3C and 4C) and the space 123 may be arranged in a matrix structure as shown in FIG. 4C.

Furthermore, the space 123 may be formed in a part of the blade body portion 122 which is not the entire part of in the blade body portion 122. Also, the space 123 may be formed adjacent to the leading edge 122*a*.

The space 123 may include a plurality of spaces 123. The spaces 123 may be formed to be separated from one another in a height direction (i.e., a radial direction) of the blade body portion 122. Furthermore, the spaces 123 may be formed to be separated from one another in a longitudinal direction of the blade body portion 122, which is perpendicular to the height direction of the blade body portion 122. In the exemplary embodiment, some of the spaces 123 may be formed between the center of the blade body portion 122 and the leading edge 122*a*. Especially, a number of the spaces 123 formed between a center of the blade body portion 122 and the leading edge 122*a* with respect to the center of the blade body portion 122 may be greater than a number of the spaces 123 formed in other parts of the blade body portion 122. In other words, most of the spaces 123 may be formed to be closer to the leading edge 122*a* based on the center of the blade body portion 122.

The spaces 123 may be formed at a specific position of the blade body portion 122. For example, the spaces 123 may be formed in the blade body portion 122 at positions where a maximum variable displacement of the blade body portion 122 occurs during rotation thereof. In other words, when the body portion 120 is rotated, the blade body portion 122 may bend due to vibration or collision with a fluid. In the exemplary embodiment, the position of the blade body portion 122 may change (i.e., displaced) from an initial position. A degree of displacement change from the initial position of the blade body portion 122 may be a variable displacement.

Aspects of the variable displacement are shown in FIG. 5. The variable displacement of the blade body portion 122 may change along the longitudinal direction thereof. Thus, the spaces 123 may be formed at a position where the variable displacement of the blade body portion 122 is maximum. For example, the spaces 123 may be formed at a position A on the blade body portion 122 in FIG. 5. In the exemplary embodiment, the spaces 123 may also be formed to be adjacent to the position A.

The vibration reduction members 130 may be placed in the spaces 123. In the exemplary embodiment, at least one of the vibration reduction members 130 may be placed in the spaces 123. For example, the vibration reduction members 130 may be formed to have a ball shape. In an exemplary embodiment, the vibration reduction members 130 may be formed to be a powder type.

The vibration reduction members 130 may include various materials. For example, the vibration reduction members 130 may include a rigid material such as a metal or a ceramic. Especially, the vibration reduction members 130 may include the same material as the blade body portion 122.

In the case of the blade assembly 100, the body portion 120 is formed and disposed on the rotor 110. The spaces 123 in the blade body portion 122 may be formed to have various shapes. For example, the blade body portion 122 includes a plurality of parts and grooves are formed respectively in joining parts joined by welding. Thus, the spaces 123 are formed in the blade body portion 122. In an exemplary embodiment, for example, the spaces 123 are formed during manufacturing of the blade body portion 122 by a direct metal laser sintering (DMLS) method and forming the vibration reduction members 130 placed in the spaces 123.

The blade assembly 100 manufactured as described above may generate a fluid flow by rotating. When the spaces 123 and the vibration reduction members 130 are not formed in the blade assembly 100, the blade body portion 122 may bend in the longitudinal direction as illustrated in FIG. 5. Particularly, the variable displacement of the blade body portion 122 may change according to the longitudinal direction thereof.

In the exemplary embodiment, the variable displacement of the blade body portion 122 may increase at a position where the variable displacement of the blade body portion 122 becomes maximum and thus, the dynamic stress applied to the blade body portion 122 may become minimum. Meanwhile, the dynamic stress applied to the blade body portion 122 may be maximum at a position where a bending phenomenon occurs. A frequency of the blade body portion 122 may reach a resonance frequency according to a rotation speed thereof. In this case, the variable displacement of the blade body portion 122 may be larger due to a resonance phenomenon and the blade body portion 122 may break due to increase of the dynamic stress.

The spaces 123 are formed to reduce an effect resulting from the resonance phenomenon as described above, by placing the vibration reduction members 130 placed in the spaces 123. In detail, the spaces 123 may be formed at an internal position of the blade body portion 122 where the variable displacement becomes maximum. Therefore, the spaces 123 may not be formed at a position of the blade body portion 122 where the dynamic stress becomes the maximum during the rotation thereof. Furthermore, the vibration reduction members 130 placed in the spaces 123 may minimize the variable displacement of the blade body portion 122 in a resonance state that is generated when the blade body portion 122 rotates.

Meanwhile, the vibration reduction members 130 formed in the spaces 123 may reduce the variable displacement that results from the resonance of the blade body portion 122. In detail, when the blade body portion 122 rotates in the vicinity of the resonance frequency, the vibration reduction members 130 may rotate slower than the blade body portion 122 due to inertia. In the exemplary embodiment, a frictional contact may be generated between the vibration reduction members 130 having a constant mass m. A frictional force $F_f$ generated by frictional contact has a different phase from a speed $\dot{X}$ of each of the vibration reduction members 130 during resonance. If $\ddot{X}$ is an acceleration of each of the vibration reduction members 130 during resonance, the following Equations are established between the mass m multiplied by the acceleration $\ddot{X}$ and the frictional force $F_f$. A displacement of the blade body portion 122 may be reduced due to friction between the vibration reduction members 130.

$$m\ddot{X}+F_f=0,\dot{X}>0 \quad \text{[Equation 1]}$$

$$m\ddot{X}-F_f=0,\dot{X}<0 \quad \text{[Equation 2]}$$

Meanwhile, if the spaces 123 and the vibration reduction members 130 are not formed, the maximum dynamic stress applied to the blade body portion 122 reaches infinity at a resonance frequency. However, in the case of the blade assembly 100 according to an exemplary embodiment, as described above, the dynamic stress applied to the blade body portion 122 may be reduced at the resonance frequency by the vibration reduction members 130 placed in the spaces 123. For example, the dynamic stress applied to the blade body portion 122 may increase rapidly at the resonance frequency. In the exemplary embodiment, the blade body portion 122 may break as the dynamic stress exceeds a resistance thereof. However, by forming the spaces 123 and placing the reduction members 130 therein, the dynamic stress may be reduced at the resonance frequency when the blade body portion 122 rotates, and thus, a breakage or a deformation of the blade assembly 100 may be prevented. Therefore, the vibration reduction members 130 may increase the lifespan of the blade assembly 100.

Referring to FIG. 7 showing analysis results obtained by a dynamic stress analysis program, it can be seen that the dynamic stress formed in the blade body portion 122 is reduced by the vibration reduction members 130 placed in the spaces 123. In detail, the dynamic stress applied to the blade body portion 122 when the vibration reduction members 130 are formed is about ⅕ times of the maximum dynamic stress applied to the blade body portion 122 at the resonance frequency of when the vibration reduction members 130 are not formed.

In accordance with exemplary embodiments described above, the blade body portion 122 having one or more internal cavities at least partially filled with metal powder with different contours provide for the frictional dissipation of energy mechanical energy. The frictional contact of the powdered metal particles (i.e., the vibration reduction members) acts to transfer mechanical energy to thermal energy. The localized heat energy may then be conducted and dissipated through radiation, convection, and/or conduction to the process fluid.

Accordingly, a breakage or a damage of the blade assembly 100 may be prevented by reducing the maximum dynamic stress at the resonance frequency.

Furthermore, the operation efficiency of the blade assembly 100 may prevent from reducing due to a deformation of the blade body portion 122 by minimizing the maximum variable displacement of the blade body portion 122.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While exemplary embodiments have been shown and described above, it will be understood by those of ordinary skill in the art that various changes in form and details may be made therein without departing from the spirit and scope of the inventive concept as defined by the following claims.

What is claimed is:

1. A blade assembly comprising:

a rotor;

a body portion connected to the rotor and comprising a space therein; and at least one vibration reducer provided in the space, wherein the space comprises a plurality of spaces, wherein the plurality of the spaces are arranged in a radial direction of the body portion and are arranged in a direction extending from a leading edge of the body portion to a trailing edge of the body portion, and wherein a first number of the plurality of spaces formed between a center of the blade body portion and the leading edge is greater than a second number of the plurality of spaces formed between the trailing edge and the center of the blade body portion.

2. The blade assembly of claim 1, wherein the space is provided adjacent to the leading edge of the body portion.

3. The blade assembly of claim 1, wherein the at least one vibration reducer is of a powder type.

4. The blade assembly of claim 1, wherein the at least one vibration reducer is configured to generate a frictional contact with the space.

5. The blade assembly of claim 4, wherein a frictional force generated by the frictional contact has a different phase from a speed of the at least one vibration reducer.

6. The blade assembly of claim 1, wherein the at least one vibration reducer is configured to rotate in a speed slower than a rotation speed of the body portion.

7. The blade assembly of claim 6, wherein the at least one vibration reducer is configured to rotate in the speed slower than the rotation speed of the body portion at a resonance frequency.

8. The blade assembly of claim 1, wherein the at least one vibration reducer and the body portion are made with the same material.

9. The blade assembly of claim 1, wherein the plurality of the spaces are arranged in a circumferential direction in the body portion.

* * * * *